US006439205B2

(12) United States Patent
Ushigome

(10) Patent No.: US 6,439,205 B2
(45) Date of Patent: Aug. 27, 2002

(54) FUEL SUPPLY UNIT

(75) Inventor: Akira Ushigome, Gunma (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/898,075

(22) Filed: Jul. 5, 2001

(30) Foreign Application Priority Data

Jul. 25, 2000 (JP) ..... 2000-223514

(51) Int. Cl.[7] ..... F02M 37/04

(52) U.S. Cl. ..... 123/509; 123/510; 137/565.24; 137/565.34

(58) Field of Search ..... 123/509, 510, 123/514, 516; 137/565.01, 571, 572, 574, 565.17, 565.24, 565.34

(56) References Cited

U.S. PATENT DOCUMENTS 5,080,077 A * 1/1992 Sawert et al. ..... 123/509
5,195,494 A 3/1993 Tuckey ..... 123/514
5,647,329 A * 7/1997 Bucci et al. ..... 123/509
5,669,359 A * 9/1997 Kleppner et al. ..... 123/509
5,749,345 A * 5/1998 Treml ..... 123/456
5,762,049 A * 6/1998 Jones et al. ..... 123/514
5,787,865 A * 8/1998 Harris et al. ..... 123/516
6,260,543 B1 * 7/2001 Chih ..... 123/509
6,308,733 B2 * 10/2001 Murakoshi et al. .... 137/565.34

FOREIGN PATENT DOCUMENTS

JP 6-123261 5/1994

* cited by examiner

*Primary Examiner*—Carl S. Miller
(74) *Attorney, Agent, or Firm*—Foley & Lardner

(57) ABSTRACT

A fuel supply unit includes a pump module in a fuel tank. The pump module has a cover member, a fuel pump, a fuel filter, and a suction filter. The fuel pump, the fuel filter and the suction filter are mounted on a lower portion of the cover member. Moreover, the fuel supply unit includes a chamber movably mounted to the pump module and disposed in a position to receive the suction filter for forming a fuel reservoir around the suction filter. The chamber has a suction pump for sucking fuel in the fuel tank to the fuel reservoir using fuel returned into the fuel tank. Furthermore, the fuel supply unit includes a spring between the pump module and the chamber. The spring biases the chamber toward a lower surface member of the fuel tank so as to maintain the chamber at the lower surface member of the fuel tank.

16 Claims, 8 Drawing Sheets

FUEL SUPPLY UNIT

BACKGROUND OF THE INVENTION

The present invention relates to a fuel supply unit which is preferable for supplying fuel in a fuel tank to an engine and the like of a motor vehicle.

SUMMARY OF THE INVENTION

It is an object of the present invention to provide a fuel supply unit that can stably supply fuel in a fuel tank, with a pump module, to an engine even when a bottom portion of the fuel tank is deformed, to thereby increase reliability.

According to the present invention, there is provided a fuel supply unit which comprises a pump module disposed in a fuel tank. The pump module has a cover member, a fuel pump, a fuel filter, and a suction filter. Each of the fuel pump, the fuel filter and the suction filter is mounted on a lower portion of the cover member. Moreover, the fuel supply unit comprises a chamber adapted to be movably mounted to the pump module. The chamber is disposed in a position to receive the suction filter for forming a fuel reservoir around the suction filter. The chamber has a suction pump for sucking fuel in the fuel tank to the fuel reservoir using fuel which is returned into the fuel tank. Furthermore, the fuel supply unit comprises a biasing means disposed between the pump module and the chamber. The biasing means biases the chamber toward a lower surface member of the fuel tank so as to maintain the chamber at the lower surface member of the fuel tank.

The other objects and features of the present invention will become understood from the following description with reference to the accompanying drawing.

DETAILED DESCRIPTION OF THE PREFERRED EMBODIMENT

Figure 1:
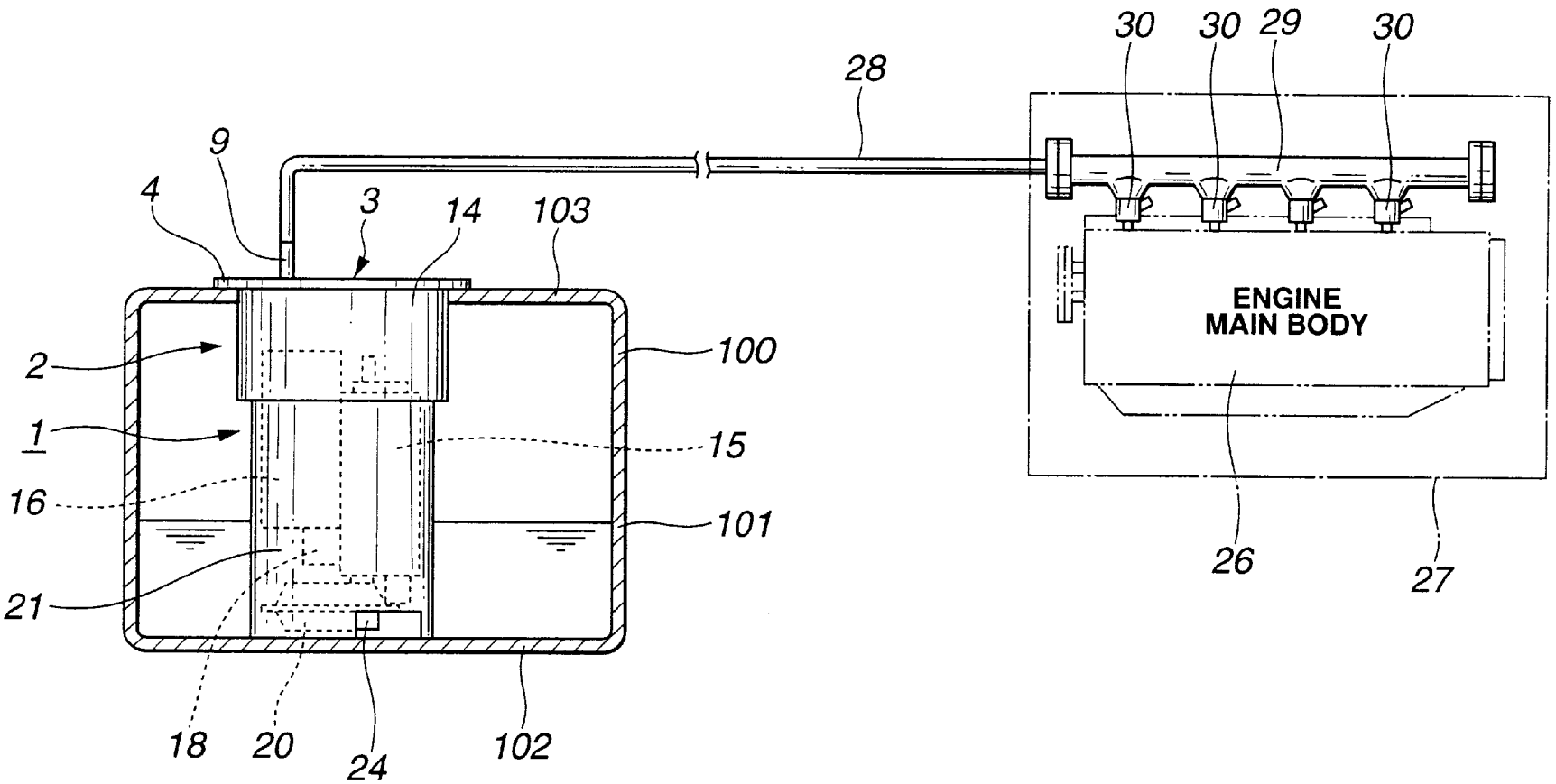
FIG. 1 is a constitution of a non-return type fuel supply system using a fuel supply unit 1, according to a first preferred embodiment of the present invention.

Generally, a fuel supply unit of an engine and the like of a motor vehicle has a constitution that has component parts such as a fuel pump, a fuel filter, a pressure regulator and the like integrated, by means of a mount bracket, into a unit for assembly. And the thus integrated unit is mounted in the fuel tank.

According to a related art having the above type of fuel supply unit, there is provided a cover member and a pump module so as to constitute the fuel supply unit. The cover member is mounted to a mount hole and the like which is disposed on an upper side of the fuel tank. On the other hand, the pump module is suspended in the fuel tank from the cover member by way of the mount hole, and is an integration of the fuel pump, the fuel filter and the like.

The cover member is provided with a fuel feed port for supplying the fuel (outflowing from the pump module) to an outside of the fuel tank. On an upper side of the pump module, there is provided an outflow port through which the fuel (discharged from the fuel pump) outflows. The outflow port is connected to a fuel feed port of the cover member by means of a plastic hose and the like.

The pump module is vertically suspended from the cover member in the fuel tank by means of a support member and the like, and is disposed in the vicinity of a bottom portion of the fuel tank. Moreover, on a lower side of the pump module, there is provided a suction filter for sucking the fuel in the fuel tank. The suction filter is connected to a suction side of the fuel pump.

Furthermore, during an operation of the fuel supply unit, the fuel in the fuel tank is sucked, by way of the suction filter, into the fuel pump. With the fuel thus sucked during the operation, the fuel is discharged from the fuel pump and is then purified with the fuel filter. Thereafter, the thus discharged and purified fuel outflows from the outflow port of the pump module, and is supplied, by way of the hose and the fuel feed port, to the outside of the fuel tank. Still thereafter, the fuel is injected into an combustion chamber of the engine by means of an injection valve.

According to the above related art, the fuel tank is likely to be molded using resin so as to reduce weight of the motor vehicle. The thus resin-molded fuel tank is likely to cause deflection and deformation attributable to such factors as thermal expansion (due to external temperature change and the like), thermal contraction (due to external temperature change and the like) and fuel weight. Therefore, the bottom portion of the fuel tank is likely to be displaced upward and downward relative to the suction filter of the pump module.

As a result, during the operation of the motor vehicle, the bottom portion of the fuel tank may be so deformed as to be separated from the suction filter. If a fuel level in the fuel tank is greatly inclined, during the above separation of the bottom portion of the fuel tank from the suction filter, due to a sudden acceleration, deceleration and the like of the motor vehicle, the fuel may run short around the suction filter. Thereby, according to the above related art, the fuel supplied into the injection valve from the pump module is likely to become unstable in volume, thus sacrificing reliability.

As is seen FIG. 1 to FIG. 6, there is provided a fuel supply unit 1, according to a first preferred embodiment of the present invention. The fuel supply unit 1 is applied to an engine of a motor vehicle and the like.

Described below is a constitution of the fuel supply unit 1.

The fuel supply unit 1 is mounted to a fuel tank 100 which is installed in the motor vehicle. The fuel tank 100 is made of a resin material and the like. The fuel tank 100 is constituted of a circumferential wall member 101, a lower surface member 102 (or referred to as a bottom surface member 102) and an upper surface member 103. The lower surface member 102 forms a lower surface of the circumferential wall member 101, while the upper surface member 103 forms an upper surface of the circumferential wall member 101.

According to the first preferred embodiment, a pressure regulator 18 (to be described afterward) is disposed in the fuel tank 100. Moreover, as is seen in FIG. 1, a fuel pipe 29 (to be described afterward) has a downstream side which is formed into a blocking end. Thereby, the fuel supply unit 1 according to the first preferred embodiment constitutes a fuel supply system of what is called a non-return type.

Moreover, as is seen in FIG. 2 to FIG. 6, the fuel supply unit 1 is constituted of a pump module 2 (to be described afterward), a chamber 21 (to be described afterward), a bias spring 25 (to be described afterward), and the like. The bias spring 25 is used for biasing the chamber 21.

Figure 6:
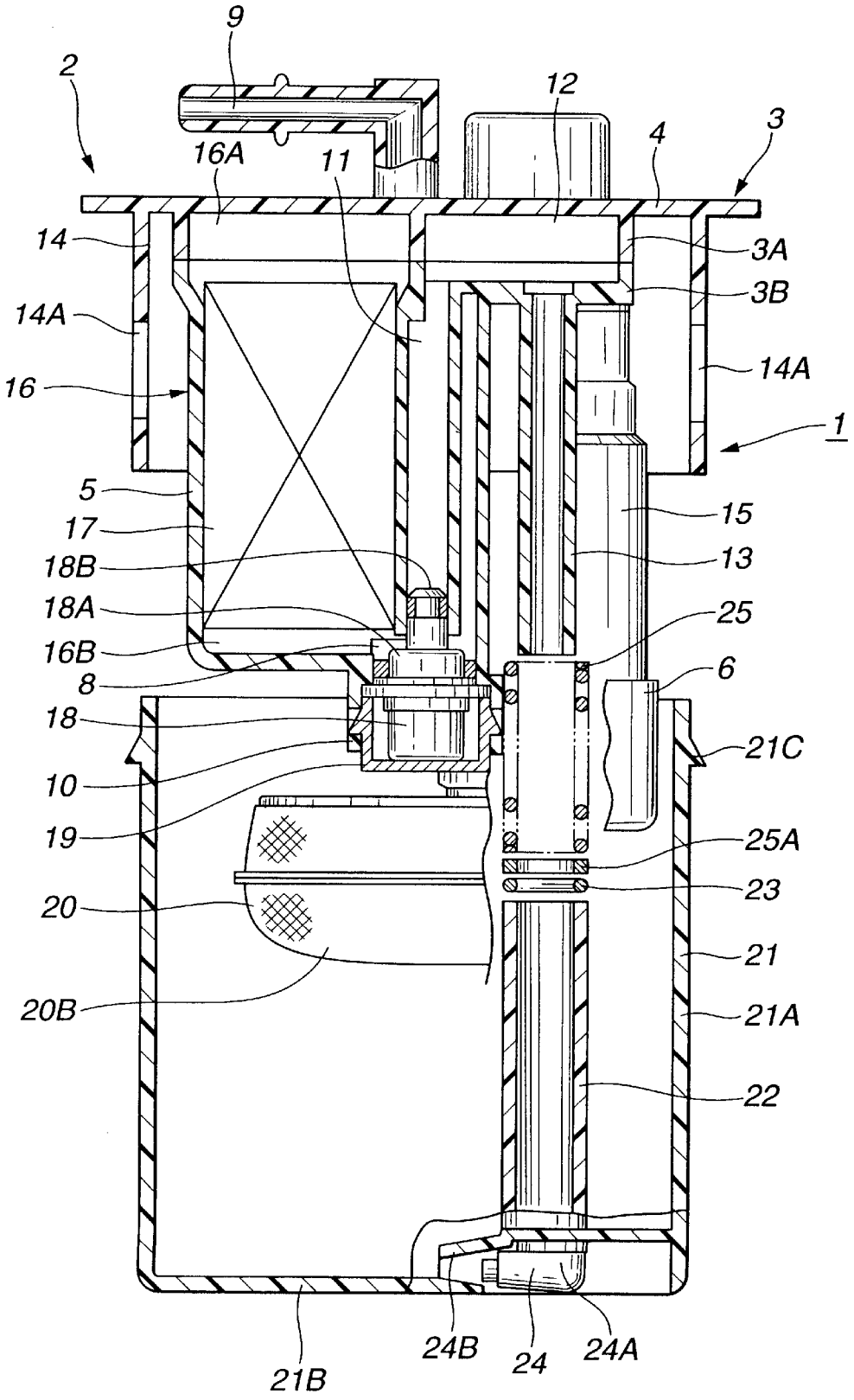
FIG. 6 is an exploded view of the fuel supply unit 1 before assembling a pump module 2, chamber 21 and a bias spring 25 (for biasing the chamber 21)

A pump module 2 constitutes a part of the fuel supply unit 1. As is seen in FIG. 6, the pump module 2 is constituted of a mount bracket 3 (to be described afterward), a fuel pump 15 (to be described afterward), a fuel filter 16 (to be described afterward), the pressure regulator 18, and a suction filter 20 (to be described afterward).

The mount bracket 3 constitutes a main body portion of the pump module 2. As is seen in FIG. 2 to FIG. 5, the mount bracket 3 is formed in such a manner that each of an upper part body 3A and a lower part body 3B is molded (resin) and the thus molded (resin) upper part body 3A and lower part body 3B are joined with each other.

The mount bracket 3 has a cover member 4 (to be described afterward), a filter case 5 (to be described afterward), a pump mount member 6 (to be described afterward), a pump connecting member 7 (to be described afterward), a feed pipeline 8 (to be described afterward), and a fuel feed port 9 (to be described afterward). The cover member 4 is substantially circular and flat in shape. The filter case 5 is disposed on a lower side of the cover member 4, has a bottom, and is shaped substantially into a cylinder. The pump mount member 6 is disposed at a lower portion of the filter case 5 and outside the filter case 5, and is shaped substantially into a circular arc (see FIG. 3). The pump connecting member 7 is disposed at an upper portion of the filter case 5 and outside the filter case 5 (see FIG. 3). The feed pipeline 8 is disposed outside the filter case 5 (see FIG. 3), extends upward and downward (see FIG. 2 and FIG. 3), and has a lower portion which is open to an outflow chamber 16B of the fuel filter 16 (see FIG. 5). The fuel feed port 9 is disposed on the cover member 4 in such a manner as to project substantially in a form of an alphabetical "L", and communicates with an upper portion of the feed pipeline 8 (see FIG. 2).

Moreover, the mount bracket 3 has a pressure regulator mount member 10 (to be described afterward), a fuel return pipeline 11 (to be described afterward), a fuel return chamber 12 (to be described afterward), and a fuel return pipe 13 (to be described afterward). The pressure regulator mount member 10 is disposed on a lower side of the filter case 5, communicates to the outflow chamber 16B of the fuel filter 16, and is substantially tubular in shape. The fuel return pipeline 11 is positioned outside the filter case 5 (see FIG. 3), extends upward and downward (see FIG. 2), and has a lower side which is connected to the pressure regulator mount member 10. The fuel return chamber 12 communicates to an upper side of the fuel return pipeline 11. The fuel return pipe 13 has a hole which is open to the fuel return chamber 12. Furthermore, the mount bracket 3 has a chamber mount member 14 (to be described afterward) to which the chamber 21 is mounted.

Figure 2:
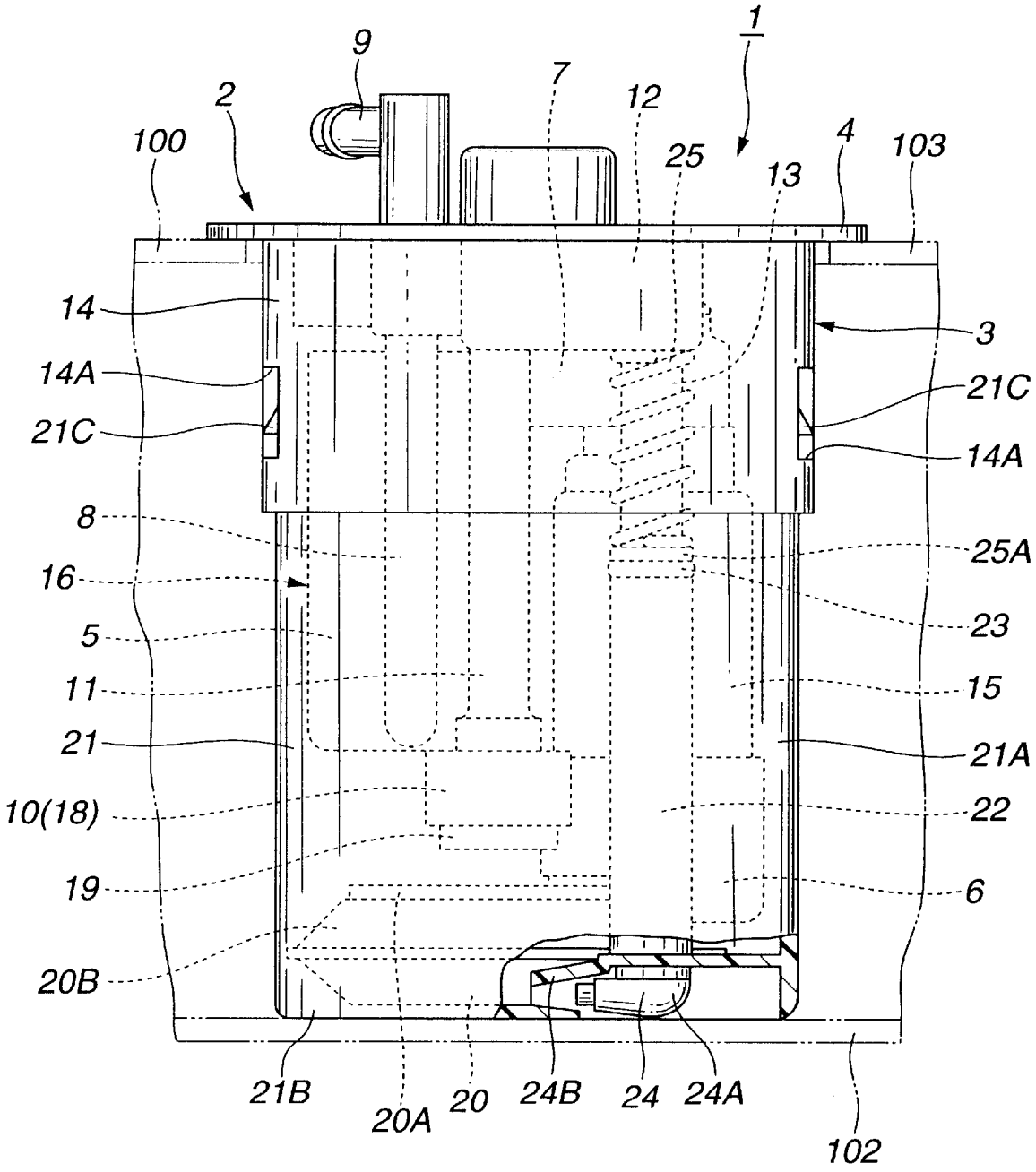
FIG. 2 is a front view of the fuel supply unit 1, according to the first preferred embodiment of the present invention.

As is seen in FIG. 2, the mount bracket 3 is fixed to the upper surface member 103 of the fuel tank 100 in such a manner that the cover member 4 blocks a mount hole which is disposed on the upper surface member 103. Each of the fuel pump 15, the fuel filter 16, the pressure regulator 18 and the like is mounted to the lower side of the mount bracket 3, and is suspended vertically in the fuel tank 100.

Figure 5:
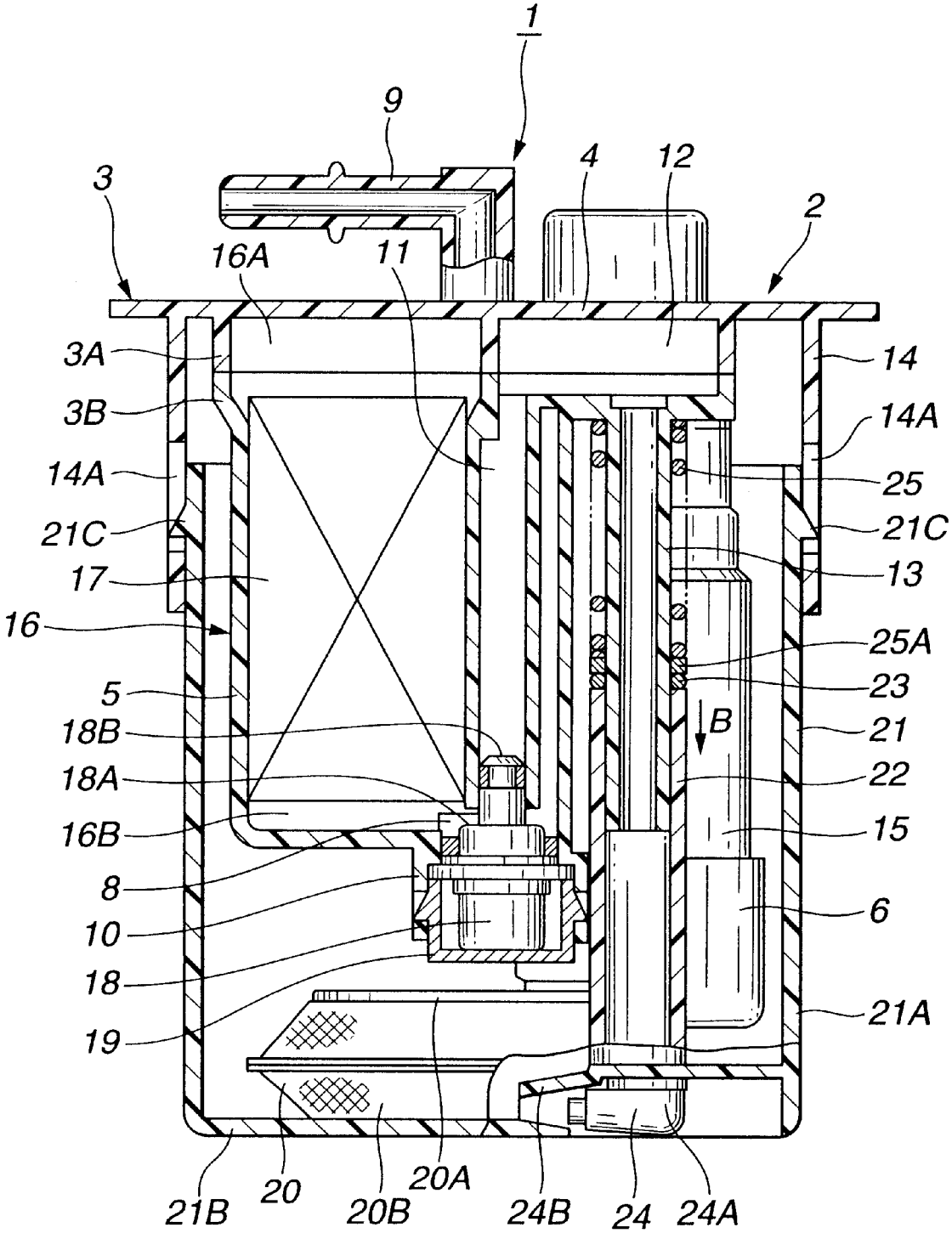
FIG. 5 is a cross sectional view of the fuel supply unit 1 taken along lines V—V in FIG. 3.

The fuel return pipe 13 is disposed on a lower side of the mount bracket 3. As is seen in FIG. 5, the fuel return pipe 13 projects downward from the fuel chamber 12 toward a bottom portion 21B of the chamber 21. The fuel return pipe 13 has a lower side which is connected, by way of a pipe 22 for a suction pump 24 (to be described afterward), to a nozzle member 24A of the suction pump 24. Moreover, the fuel return pipe 13 returns the fuel (which outflows from a return port 18B of the pressure regulator 18) into the fuel tank 100.

Figure 3:
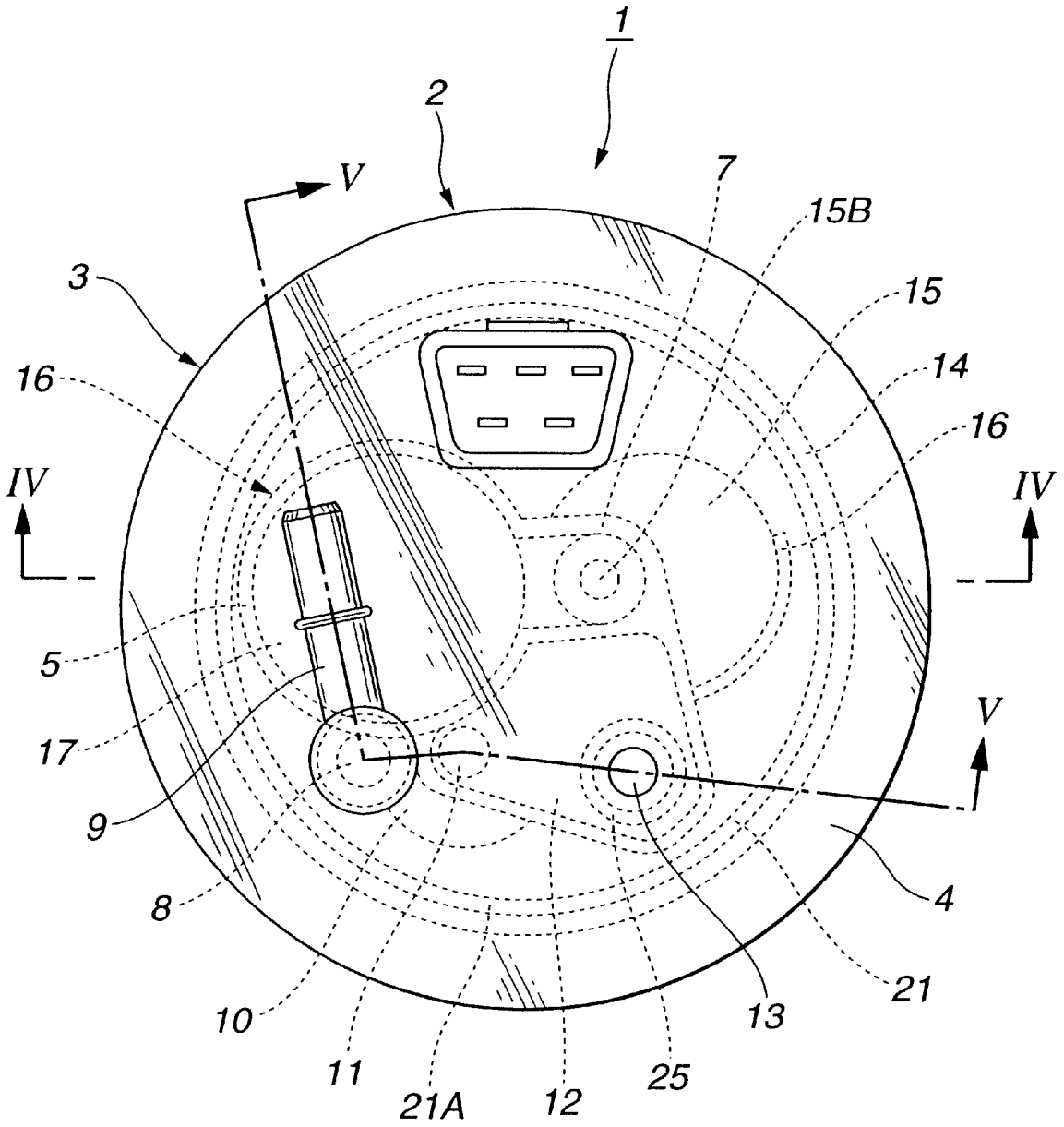
FIG. 3 is a plan view of the fuel supply unit 1 shown in FIG. 2.

The chamber mount member 14 is disposed at the cover member 4 of the mounting bracket 3. As is seen in FIG. 2 and FIG. 3, the chamber mount member 14 is so positioned as to surround the fuel pump 15 and the fuel filter 16, is substantially tubular in shape, and projects downward from the cover member 4. Moreover, the chamber mount member 14 is disposed in the fuel tank 100 by way of a mount hole of the fuel tank 100. There are defined a plurality of slotted holes 14A. Each of the slotted holes 14A extends upward and downward for engaging with a claw member 21C (to be described afterward) of the chamber 21. The slotted holes 14A are disposed at intervals circumferentially. The chamber mount member 14 connects to the chamber 21 in such a manner that the chamber 21 moves upward and downward relative to the pump module 2 .

Figure 4:
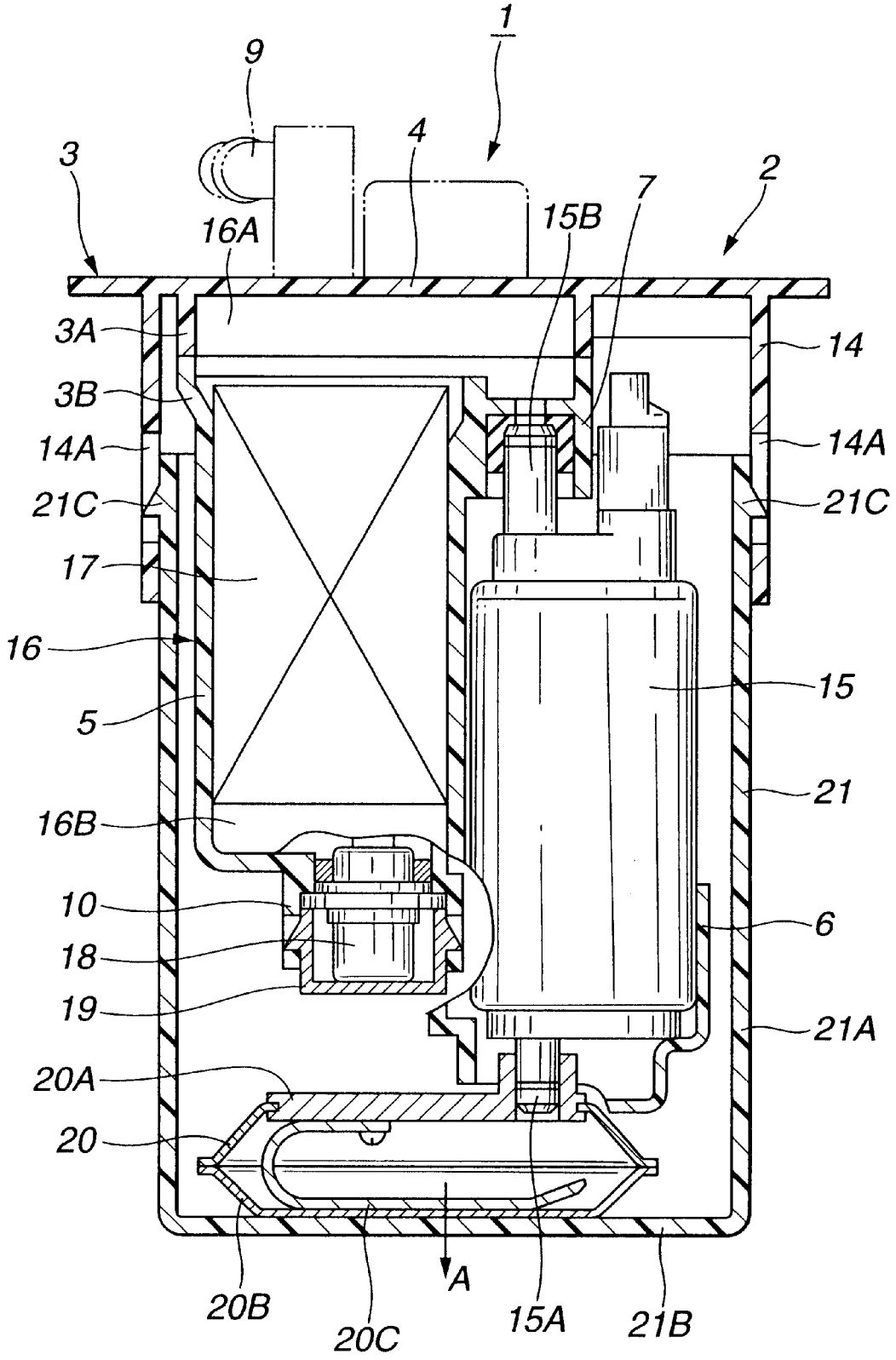
FIG. 4 is a cross sectional view of the fuel supply unit 1 taken along lines IV—IV in FIG. 3.

The fuel pump 15 is mounted on the pump mount member 6 of the mount bracket 3, and is shaped substantially into a cylinder. As is seen in FIG. 4, the fuel pump 15 has a suction port 15A, and a discharge port 15B. The suction port 15A is provided with the suction filter 20 (to be described afterward). The discharge port 15B is connected to the pump connecting member 7 of the mount bracket 3.

Being electrically energized, the fuel pump 15 sucks the fuel in the fuel tank 100 from the suction port 15A. Then, the fuel pump 15 discharges the thus sucked fuel from the discharge port 15B into an inflow chamber 16A of the fuel filter 16. Then, the thus discharged fuel (a partial amount) outflows, by way of the fuel filter 16 and the feed pipeline 8, from the fuel feed port 9 of the pump module 2. Thereby, the discharged fuel is supplied to an injection valve 30 (to be described afterward) as is seen in FIG. 1. Simultaneously with this, a remaining amount of the thus discharged fuel is returned to the fuel tank 100 by means of the pressure regulator 18.

The fuel filter 16 is mounted to the mount bracket 3. The fuel filter 16 is constituted of the filter case 5 and a filter element 17 (to be described afterward). The filter element 17 is made of a porous material (shaped substantially into a sponge), and is housed in the filter case 5. In the fuel filter 16, there are provided the inflow chamber 16A and the outflow chamber 16B which are positioned, respectively, on an upper side and a lower side of the filter element 17. The fuel filter 16 purifies the fuel in the following sequence: The fuel in the inflow chamber 16A is filtered through the filter element 17, and then inflows into the outflow chamber 16B.

The pressure regulator 18 is mounted, by means of a cap 19, to the pressure regulator mount member 10 of the mount bracket 3. As is seen in FIG. 5 and FIG. 6, the pressure regulator 18 has an inflow port 18A, the return port 18B, a valve mechanism (not shown), and the like. From the outflow chamber 16B of the fuel filter 16, the fuel inflows into the inflow port 18A. The return port 18B is connected to the lower side of the fuel return pipeline 11. The valve mechanism allows the fuel to communicate between the inflow port 18A and the return port 18B, and blocks the fuel (in other words, prevents the fuel from communicating), in accordance with a pressure of the outflow chamber 16B.

More specifically, when the pressure of the outflow chamber 16B is not more than a predetermined valve, the pressure regulator 18 blocks the fuel from communicating between the inflow port 18A and the return port 18B. Contrary to this, when the pressure of the outflow chamber 16B is more than the predetermined value, the pressure regulator 18 allows the fuel to communicate between the inflow port 18A and the return port 18B. With the above communication and the block of the fuel, the fuel discharged by means of the fuel pump 15 partially outflows from the return port 18B to the fuel return pipeline 11. Thereby, the pressure regulator 18 maintains the pressure of the fuel at substantially a constant value (The fuel is the one that is supplied from the fuel supply unit 1 to the injection valve 30.).

The suction filter 20 is mounted to the suction port 15A of the fuel pump 15. As is seen in FIG. 4 to FIG. 6, the suction filter 20 is constituted of a bracket 20A, a filter member 20B and a press spring 20C. The bracket 20A is mounted to the suction port 15A, and is shaped substantially into a plate. The filter member 20B is made of a plastic mesh material, is shaped substantially into a bag, and is mounted to the bracket 20A in such a position as to cover the suction port 15A of the fuel pump 15. The press spring 20C is so positioned in the filter member 20B as to be mounted to the bracket 20A.

The filter member 20B prevents foreign matters and the like from being sucked into the fuel pump 15. The foreign matters are particles contained in the fuel. Moreover, the press spring 20C is formed by elastically deforming a metal plate, a resin plate and the like substantially into a shape of an alphabetical "U." The press spring 20C has a base end (upper in FIG. 4) which is fixed to the bracket 20A, and a tip end which is biased in the direction "A" toward the lower surface member 102 of the fuel tank 100, as is seen in FIG. 4.

As is seen in FIG. 6, when the chamber 21 is not mounted to the pump module 2, the filter member 20B is swelled downward (free state) by dint of a spring force of the press spring 20C. Contrary to this, as is seen in FIG. 4, when the chamber 21 is mounted to the pump module 21, the filter member 20B contracts upward and downward in such a manner as to oppose the press spring 20C, thus elastically abutting on the bottom portion 21B of the chamber 21.

Thereby, the filter member 20B of the suction filter 20 is displaced, in accordance with the bottom portion 21B of the chamber 21, by dint of the spring force of the press spring 20C. The above displacement of the filter member 20B is not influenced even when the chamber 21 is moved upward and downward attributable to upward and downward deformation of the lower surface member 102 and the like of the fuel tank 100.

The chamber 21 is connected to the pump module 2 in such a manner as to be displaceable upward and downward. As is seen in FIG. 4 and FIG. 5, the chamber 21 is made of one of resin material, metal material and the like, and is substantially tubular in shape. The chamber 21 has an upper side which is open, a tubular portion 21A, and a lower side blocked (the bottom portion 21B). Moreover, at the upper portion and on an external circumference of the chamber 21, there are defined the plurality of the claw members 21C projecting at intervals circumferentially.

The upper side of the chamber 21 is movably inserted into the chamber mount member 14 of the pump module 2. Each of the claw members 21C movably engages with one of the slotted holes 14A of the chamber mount member 14. Thereby, the chamber 21 is mounted to the pump module 2 in such a manner as to be displaceable upward and downward within a longitudinal length defined by the slotted hole 14A. A spring force of the bias spring 25 allows the chamber 21 to abut on the lower surface member 102 of the fuel tank 100.

In a space defined in the chamber 21, the suction filter 20 and the like are received. The space can be a reservoir for reserving the fuel which stays around the suction filter 20 even when a fuel level in the fuel tank 100 is inclined.

The pipe 22 for the suction pump 24 stands on a side defining the bottom portion 21B of the chamber 21. As is seen in FIG. 5, the pipe 22 is made of resin material and the like, and is formed integrally with the chamber 21. The pipe 22 has a lower portion which is connected to the nozzle member 24A of the suction pump 24. Moreover, the pipe 22 has an upper portion which movably engages with the fuel return pipe 13 of the pump module 2. The above engagement is sealed with an O-ring 23. Moreover, the pipe 22 leads the fuel (outflowing from the fuel return pipe 13 of the pump module 2) to the suction pump 24 of the chamber 21.

The suction pump 24 is disposed on the side defining the bottom portion 21B of the chamber 21. As is seen in FIG. 5 and FIG. 6, the suction pump 24 has the nozzle member 24A and a suction portion 24B. The nozzle member 24A has a base end which is connected to the pipe 22 for the suction pump 24, and a tip end which is reduced in diameter and is open toward inside of the chamber 21. The suction portion 24B is substantially tubular in shape having substantially a cone. The suction portion 24B has a base end which is open toward outside of the chamber 21, and a tip end which is reduced in diameter and is open toward inside of the chamber 21. With the nozzle member 24A and the suction portion 24B, the suction pump 24 constitutes substantially a jet pump.

The fuel outflowing from the fuel return pipe 13 of the pump module 2 inflows, by way of the suction pump 22, into the nozzle member 24A. The fuel is then outflows from the tip end of the nozzle member 24A at a high flow velocity, to thereby cause a vacuum in the suction portion 24B. Thereby, the suction pump 24 sucks the fuel from outside of the chamber 21. The thus sucked fuel is discharged into the chamber 21 together with the fuel that outflows from the fuel return pipe 13.

The bias spring 25 is a measure for biasing the chamber 21, and is disposed between the pump module 2 and the chamber 21 in a compressed condition. The bias spring 25 is a coil spring and the like which fits around an external circumference of the fuel return pipe 13. The bias spring 25 has an upper portion abutting on the pump module 2, and has a lower portion abutting on a spring seat 25A which is substantially annular.

Moreover, as is seen in FIG. 5, the bias spring 25 biases, by way of the O-ring 23 and the pipe 22, the chamber 21 in a direction indicated by "B." The bias spring 25 elastically presses the bottom portion 21B to the lower surface member 102 of the fuel tank 100. Moreover, when the lower surface member 102 is deformed (or is displaced) upward and downward, the bias spring 25 displaces the chamber 21 in accordance with the deformation (displacement) of the lower surface member 102.

On the other hand, as is seen in FIG. 1, there is provided an engine main body 26 and a fuel feed tube 28. The engine main body 26 is disposed in an engine room 27. The fuel feed tube 28 feeds the fuel to the engine main body 26. The fuel feed tube 28 has an upstream side which is connected to the fuel feed port 9 of the fuel supply unit 1, and has a downstream side which is connected to the fuel pipe 29. The fuel pipe 29 is mounted to the engine main body 26. Moreover, the fuel pipe 29 has a plurality of the injection valves 30 each corresponding to one of cylinders of the engine main body 26. The downstream side of the fuel pipe 29 is formed with a blocking end.

Following the constitution of the fuel supply unit 1, described below is an operation of the fuel supply unit 1.

For assembling the fuel supply unit 1, the following sequential steps are taken referring to FIG. 6:

1. The pump module 2 is assembled in advance.
2. The bias spring 25 and the like (for biasing the chamber 21) is mounted on the fuel return pipe 13 of the thus assembled pump module 2.
3. The fuel return pipe 13 is inserted in the pipe 22 (for the suction pump 24) of the chamber 21. Simultaneously with this, the chamber mount member 14 of the pump module 2 is engaged with the upper portion of the chamber 21.
4. The slotted hole 14A of the chamber mount member 14 is engaged with the claw member 21C of the chamber 21, to thereby complete the fuel supply unit 1.

For mounting the fuel supply unit 1 to the fuel tank 100, the following sequential steps are taken:

1. The fuel supply unit 1 is inserted from the mount hole (of the upper surface member 103 of the fuel tank 100) toward the lower surface member 102, so that the bottom portion 21B of the chamber 21 abuts on the lower surface member 102 of the fuel tank 100.
2. The bias spring 25 for biasing the chamber 21 is compressed. Simultaneously with this, the cover member 4 of the pump module 2 is allowed to abut on the upper surface member 103 of the fuel tank 100.
3. By means of a mount screw and the like, the cover member 4 is fixed to the upper surface member 103, to thereby mount the fuel supply unit 1 to the fuel tank 100.

With the above sequential steps taken, the chamber 21 is pressed to the lower surface member 102 of the fuel tank 100 by dint of the bias spring 25, while the filter member 20B of the suction filter 20 is pressed to the bottom portion 21B of the chamber 21 by means of the dint spring 20C.

When the fuel supply unit 1 is under operation, the following sequential operations are observed:

1. The fuel pump 15 is driven.
2. As is seen in FIG. 4, the fuel in the chamber 21 is sucked from the suction filter 20 to the suction port 15A.
3. The thus sucked fuel is discharged from the discharge port 15B to the inflow chamber 16A of the fuel filter 16 (FIG. 5).
4. The thus discharged fuel is filtered by the filter element 17, as is seen in FIG. 5.
5. The thus filtered fuel (a partial amount of fuel) is supplied from the outflow chamber 16B, by way of the feed pipeline 8 and the fuel feed port 9, to the outside of the fuel tank 100.
6. The thus supplied fuel is injected from each of the injection valves 30 into one of cylinders of the engine main body 26.

On the other hand, a remaining amount of the fuel discharged by means of the fuel pump 15 takes the following sequential route, as is seen in FIG. 5:

1. Reaches the inflow chamber 16A of the fuel filter 16.
2. By way of the inflow port 18A of the pressure regulator 18, the return port 18B, the fuel return pipeline 11, the fuel return chamber 12, the fuel return pipe 13, the pipe 22 (for the suction pump 24 of the chamber 21), inflows into the nozzle member 24A of the suction pump 24.

With the above sequential route of the fuel, the suction pump 24 is operated, to thereby suck the fuel outside the chamber 21. The thus sucked fuel is discharged into the chamber 21 together with the fuel that is returned from the pressure regulator 18.

As a result, the fuel is maintained around the suction filter 20 by means of the chamber 21 during the operation of the motor vehicle. The above maintenance of the fuel around the suction filter 20 is not influenced by, for example, a great inclination of the fuel level in the fuel tank 100. The above great inclination is the one that is caused by a quick acceleration or deceleration of the motor vehicle in a condition that the fuel remaining in the fuel tank 100 is small in amount.

Moreover, the fuel tank 100 (made of resin material) is deflected or deformed attributable to an external temperature change, fuel weight and the like. In this case, the lower surface member 102 of the fuel tank 100 is displaced upward and downward. In accordance with the above displacement of the lower surface member 102 of the fuel tank 100, the spring force of the bias spring 25 allows the chamber 21 to move upward and downward. Likewise, simultaneously with this, the spring force of the press spring 20C (see FIG. 4) allows the filter member 20B of the suction filter 20 to move upward and downward in accordance with the above movement of the bottom portion 21B of the chamber 21. Thereby, the suction filter 20 and the chamber 21 continuously contact (or 'are immersed in') the fuel on the lower surface member 102 of the fuel tank 100. The above continuous contact (immersion) is maintained.

According to the first preferred embodiment of the present invention, the fuel supply unit 1 is constituted of the pump module 2, the chamber 21, and the bias spring 25. The pump module 2 is mounted to the upper surface member 103 of the fuel tank 100. The chamber 21 is so mounted to the pump module 2 as to be displaceable upward and downward, and is provided with the suction pump 24. The bias spring 25 biases the chamber 21 toward the lower surface member 102 of the fuel tank 100. With the thus obtained constitution of the fuel supply unit 1, the fuel pump 15, the fuel filer 16, the pressure regulator 18, the suction filter 20 and the like are integrated, to thereby assemble the pump module 2. The chamber 21 provided with the suction pump 24 can be mounted to the thus assembled pump module 2 in such a manner as to be displaceable upward and downward.

The bias spring 25 press the chamber 21 to the lower surface 102 of the fuel tank 100. Thereby, the bias spring 25 allows the chamber 21 to be displaced upward and downward in accordance with the lower surface member 102 of the fuel tank 100. The above displacement of the chamber 21 by dint of the bias spring 25 is not influenced by the deformation of the lower surface member 102 of the fuel tank 100, which deformation being attributable to, for example, the external temperature change, fuel weight and the like.

In addition, the press spring 20C mounted to the suction filter 20 allows the filter member 20B to be pressed to the bottom portion 21B of the chamber 21, to thereby allow the filter member 20B to move upward and downward together with the chamber 21.

Thereby, the chamber 21 can be continuously maintained at the lower surface member 102 of the fuel tank 100.

Moreover, the filter member 20B can be located at a lowest position in the chamber 21. Thereby, the chamber 21 can form a stable fuel reservoir around the suction filter 20. The above stability of the fuel reservoir is not influenced by the deformation of the lower surface member 102 when the fuel remaining in the fuel tank 100 is small in amount. Even when the fuel in the chamber 21 is small in amount, the suction filter 20 can surely contact (or 'be immersed in') the fuel.

Therefore, according to the first preferred embodiment, the fuel pump 15 can surely suck the fuel in the fuel tank 100 by way of the suction filter 20. The above sure suction of the fuel is not influenced by any adverse conditions such as the inclination of the fuel level in the fuel tank 100 with a small amount of fuel remaining, or the deformation of the lower surface member 102. With the fuel sucked surely, the fuel can be supplied to the injection valve 30 stably, to thereby improve reliability of the fuel supply unit 1.

Moreover, the cover member 4 of the pump module 2 is provided with the substantially tubular chamber mount member 14 to which the chamber 21 is movably connected, and the claw member 21C of the chamber 21 is movably engaged with the slotted hole 14A of the chamber mount member 14. Thereby, moving the chamber 21 upward and downward along the chamber mount member 14 requires only a simple constitution, and the chamber 21 is inhibited from being displaced in a horizontal direction. Moreover, the displacement of the chamber 21 is restricted in a range defined by a length of the slotted hole 14A, to thereby maintain the condition that the pump module 2 is connected with the chamber 21.

Furthermore, the bias spring 25 for the chamber 21 fits around the external circumference of the fuel return pipe 13 of the pump module 2, so that the bias spring 25 can be positioned stably by means of the fuel return pipe 13 which distributes the fuel from the pump module 2 to the suction pump 24. With the fuel return pipe 13 stably positioning the bias spring 25, there is no need for a special fitting such as a holder and the like for positioning the bias spring 25, thus reducing the number of component parts and simplifying the constitution of the fuel supply unit 1.

Figure 7:
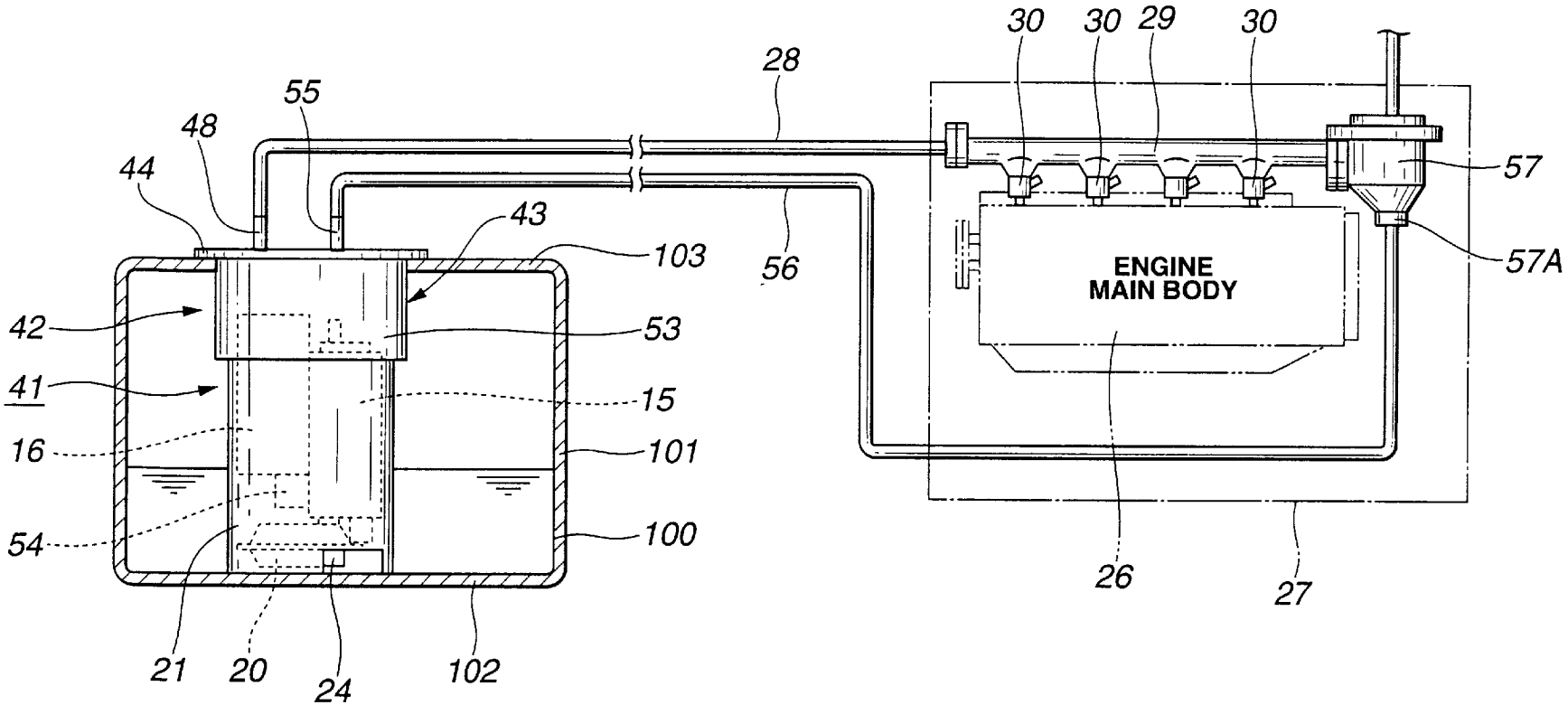
FIG. 7 is a constitution of a full-return type fuel supply system using a fuel supply unit 41, according to a second preferred embodiment of the present invention.
Figure 8:
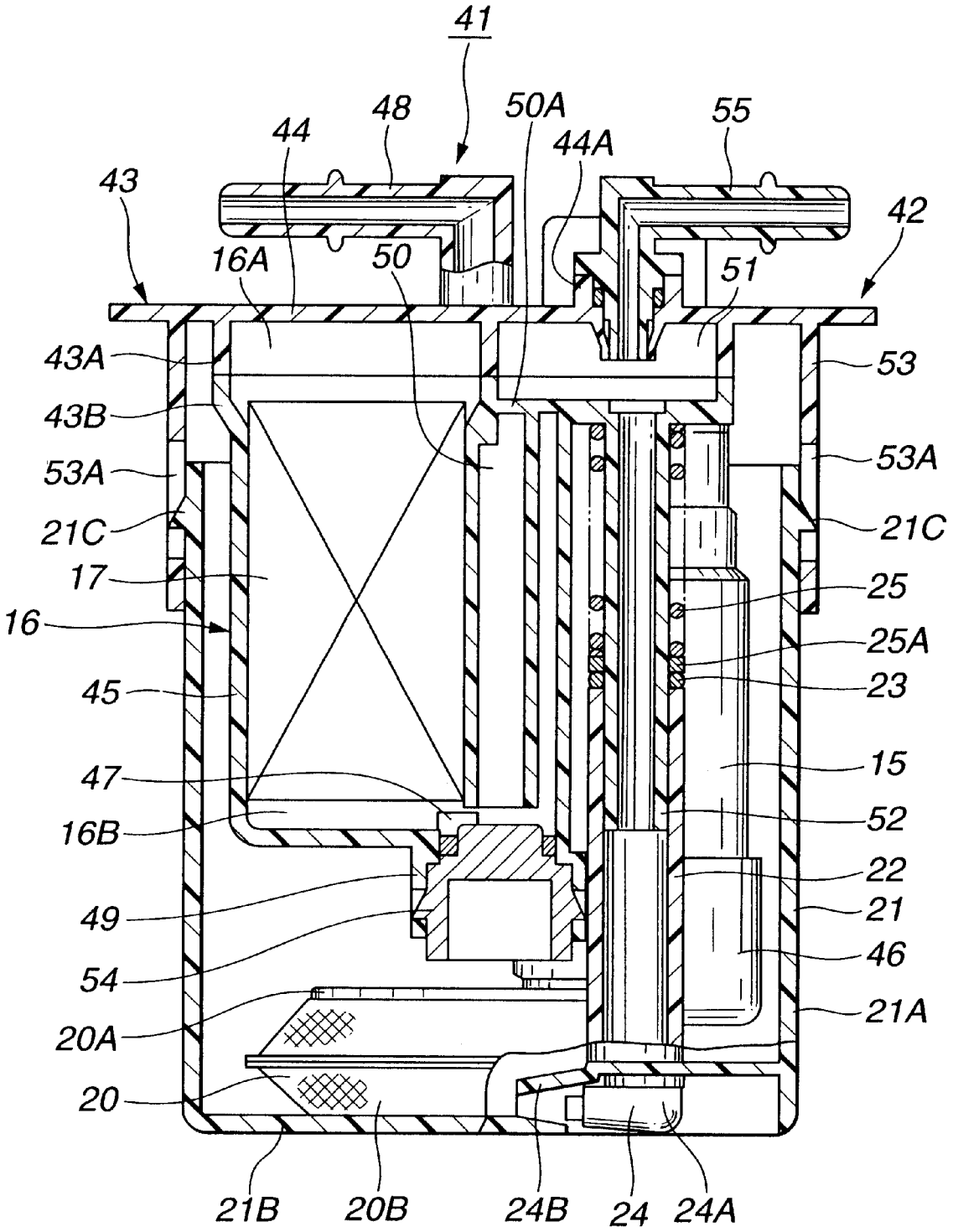
FIG. 8 is similar to FIG. 5, but showing a cross sectional view of the fuel supply unit 41, according to the second preferred embodiment of the present invention.

As is seen in FIG. 7 to FIG. 8, there is provided a fuel supply unit 41, according to a second preferred embodiment of the present invention. The fuel supply unit 41 constitutes a fuel supply system of a full-return type. In the second preferred embodiment, parts and portions substantially the same as those of the first preferred embodiment are denoted by the same numerals, and repeated explanations are to be omitted.

Described at first below is a constitution of the fuel supply unit 41.

Like the fuel supply unit 1 according to the first preferred embodiment, the fuel supply unit 41 is constituted of a pump module 42 (to be described afterward), the chamber 21, and the bias spring 25 for biasing the chamber 21. The pump module 42 is provided with the fuel pump 15, the fuel filter 16, the suction filter 20 and the like.

According to the second preferred embodiment, however, a pressure regulator 57 (to be described afterward) is disposed outside the fuel tank 100, and is connected to a downstream side of the fuel pipe 29, as is seen in FIG. 7. Thereby, the fuel supply unit 41 is of what is called the full-return type.

The pump module 42 constitutes a part of the fuel supply unit 41. As is seen in FIG. 8, the pump module 42 is constituted of a mount bracket 43 (to be described afterward), the fuel pump 15, the fuel filter 16, and the suction filter 20.

The mount bracket 43 constitutes a main body portion of the pump module 42. Like the mount bracket 3 according to the first preferred embodiment, the mount bracket 43 is formed in such a manner that an upper part body 43A and a lower part body 43B are molded (resin).

The mount bracket 43 is constituted of a cover member 44, a filter case 45, a pump mount member 46, a pump connecting member (not shown), a feed pipeline 47, a fuel feed port 48, a pressure regulator mount member 49, a block pipeline 50, a fuel return chamber 51, a fuel return pipe 52, a chamber mount member 53 and the like. The chamber mount member 53 is formed with a plurality of slotted holes 53A. The cover member 44 is provided with a boss member 44A which is open to the fuel return chamber 51 so as to mount a joint pipe 55 (to be described afterward). Moreover, the block pipeline 50 is formed in such a manner that a block portion 50A is disposed on an upper side of the fuel return pipeline 11 that is described in the first preferred embodiment, to thereby block a communication with the fuel return chamber 51.

In this case; when molding (resin) each of the upper part body 43A and the lower part body 43B, it is only replacement of cores (of metal mold) and the like that is required for forming, with ease, the boss member 44A of the cover member 44 and the block portion 50A of the block pipeline 50. The above core (of metal mold) is the one that is used for molding (resin) the mount bracket 3 according to the first preferred embodiment.

A seal plug 54 is mounted to the pressure regulator mount member 49, in place of the pressure regulator 18 and the cap 19 according to the first preferred embodiment. The seal plug 54 blocks the filter case 45 from inside of the fuel tank 100.

On the other hand, the joint pipe 55 is mounted to the boss member 44A of the cover member 44, and is shaped substantially into an alphabetical "L". As is seen in FIG. 7 and FIG. 8, the joint pipe 55 is connected, by way of a fuel return pipe 56, to a return port 57A of the pressure regulator 57, so that the joint pipe 55 allows the fuel outflowing from the return port 57A to return to inside the fuel return chamber 51 of the pump module 42.

The fuel discharged from the fuel pump 15 is supplied from the fuel tank 100, by way of the fuel feed tube 28 and the fuel pipe 29, to each of the injection valves 30. Moreover, the thus supplied fuel (a partial amount) moves from the return port 57A of the pressure regulator 57 by way of the fuel return pipe 56 and the joint pipe 55, and then inflows into the fuel return chamber 51. Thereafter, the thus inflowing fuel returns, by way of the fuel return pipe 52, to the inside of the fuel tank 100.

Following the constitution of the fuel supply unit 41, described below is an operation of the fuel supply unit 41.

The fuel supply unit 41 according to the second preferred embodiment has an operation substantially the same as that of the fuel supply unit 1 according to the first preferred embodiment. Especially, according to the second preferred embodiment, the core (of the metal mold) and the like is replaced so as to slightly change configuration of the mount bracket 43, and the seal plug 54 is disposed in place of the pressure regulator 18. Only the thus changed (in configuration) mount bracket 43 and the thus replaced seal plug 54 are enough for modifying the fuel supply unit 1 (non-return type) into the fuel supply unit 41 (full-return type). In other words, common component parts are used for the fuel supply unit 1 and the fuel supply unit 41, to thereby broaden application.

According to the first preferred embodiment and the second preferred embodiment of the present invention, each of the respective fuel return pipe 13 and the fuel return pipe 52 is movably engaged in the pipe 22 (for the suction pump 24 of the chamber 21), to thereby mount the bias spring 25 (for biasing the chamber 21) around the external circumference of the respective fuel return pipe 13 and the fuel return pipe 52 (see FIG. 5 and FIG. 8). The present invention is, however, not limited to the above. For example, each of the fuel supply unit 1 and the fuel supply unit 41 may have such a constitution that the pipe 22 is movably engaged in each of the respective fuel return pipe 13 and the fuel return pipe 52, to thereby mount the bias spring 25 around the external circumference of the pipe 22 (see FIG. 5 and FIG. 8).

The entire contents of basic Japanese Patent Application No. P2000-223514 (filed Jul. 25, 2000) of which priority is claimed is herein incorporated by reference.

The scope of the invention is defined with reference to the following claims.

What is claimed is:

1. A fuel supply unit comprising:

a pump module disposed in a fuel tank, the pump module comprising:

a cover member adapted to be mounted to an upper surface member of the fuel tank;

a fuel pump;

a fuel filter; and a suction filter, each of the fuel pump, the fuel filter and the suction filter being mounted on a lower portion of the cover member;

a chamber adapted to be movably mounted to the pump module, the chamber being disposed in a position to receive the suction filter for forming a fuel reservoir around the suction filter, the chamber comprising a suction pump for sucking fuel in the fuel tank to the fuel reservoir using fuel which is returned into the fuel tank, the chamber defining a tubular portion extending from a bottom portion of the chamber toward the cover member; and a biasing means disposed between the cover member and the chamber, the biasing means being surrounded by the tubular portion of the chamber, the biasing means biasing the chamber toward a lower surface member of the fuel tank opposite to the upper surface member so as to maintain the chamber at the lower surface member of the fuel tank.

2. The fuel supply unit as claimed in claim 1, wherein the chamber is adapted to move upward and downward, wherein the chamber is shaped substantially into a tube having an upper portion which is opened and a lower portion which is opposite to the upper portion and is formed with the bottom portion, and wherein the upper portion of the chamber is connected to the pump module while the bottom portion of the chamber abuts on the lower surface member of the fuel tank.

3. The supply unit as claimed in claim 2, wherein the suction filter comprises:

a bracket mounted to a suction port of the fuel pump;

a filter member made of plastic mesh material, and so mounted to the bracket as to cover the suction port of the fuel pump; and a press spring having a first end portion mounted to the bracket, and a second end portion for pressing the filter member to the bottom portion of the chamber.

4. A fuel supply unit comprising:

a pump module disposed in a fuel tank, the pump module comprising:

a cover member adapted to be mounted to an upper surface member of the fuel tank;

a fuel pump;

a fuel filter;

a suction filter;

a fuel return pipe for returning a part of the fuel discharged from the fuel pump into the fuel tank, each of the fuel pump, the fuel filter and the suction filter being mounted on a lower portion of the cover member;

a chamber adapted to be movably mounted to the pump module, the chamber being disposed in a position to receive the suction filter for forming a fuel reservoir around the suction filter, the chamber comprising:

a suction pump for sucking fuel in the fuel tank to the fuel reservoir using fuel which is returned into the fuel tank; and a pipe for the suction pump, the pipe for the suction pump being adapted to movably engage with the fuel return pipe in such a manner as to move relative to the fuel return pipe, and leading the fuel outflowing from the fuel return pipe to the suction pump; and a biasing means disposed between the cover member and the chamber, the biasing means biasing the chamber toward a lower surface member of the fuel tank opposite to the upper surface member so as to maintain the chamber at the lower surface member of the fuel tank, and wherein the biasing means is a coil spring which is mounted around an external circumference of one of the fuel return pipe and the pipe for the suction pump.

5. The fuel supply unit as claimed in claim 1, in which the pump module further comprises a pressure regulator for regulating a pressure of the fuel, by returning into the fuel tank a part of the fuel discharged from the fuel pump, and in which the pressure regulator has a return port which is connected to the suction pump.

6. The fuel supply unit as claimed in claim 1, in which the fuel supply unit further comprises a pressure regulator disposed outside the fuel tank, the pressure regulator being for regulating a pressure of the fuel, by returning into the fuel tank a part of the fuel discharged from the fuel pump, and in which the pressure regulator has a return port which is connected to the suction pump by way of the pump module.

7. A fuel tank for supplying fuel to an engine, the fuel tank comprising:

a circumferential wall member;

a lower surface member disposed in a lower portion of the circumferential wall member;

an upper surface member opposite to the lower surface member, the upper surface member defining a hole; and a fuel supply unit comprising:

a pump module disposed in the fuel tank, the pump module comprising:

a cover member adapted to be secured to the upper surface member of the fuel tank in such a manner as to block the hole defined by the upper surface member;

a fuel pump; and a suction filter, each of the fuel pump and the suction filter being mounted on a lower portion of the cover member;

a chamber adapted to be movably mounted to the pump module, the chamber being disposed in a position to receive the suction filter for forming a fuel reservoir around the suction filter, the chamber comprising a suction pump for sucking fuel in the fuel tank to the fuel reservoir using fuel which is returned into the fuel tank, the chamber defining a tubular portion extending from a bottom portion of the chamber toward the cover member; and a biasing means disposed between the cover member and the chamber, the biasing means being surrounded by the tubular portion of the chamber, the biasing means biasing the chamber toward the lower surface member of the fuel tank so as to maintain the chamber at the lower surface member of the fuel tank.

8. The fuel tank as claimed in claim 7, wherein the chamber is adapted to move upward and downward, wherein the chamber is shaped substantially into a tube having an upper portion which is opened and a lower portion which is opposite to the upper portion and is formed with the bottom portion, and wherein the upper portion of the chamber is connected to the pump module while the bottom portion of the chamber abuts on the lower surface member of the fuel tank.

9. The fuel tank as claimed in claim 8, in which the suction filter comprises:

a bracket mounted to a suction port of the fuel pump, a filter member made of plastic mesh material, and so mounted to the bracket as to cover the suction port of the fuel pump, and a press spring having a first end portion mounted to the bracket, and a second end portion for pressing the filter member to the bottom portion of the chamber.

10. A fuel tank for supplying fuel to an engine, the fuel tank comprising:

a circumferential wall member;

a lower surface member disposed in a lower portion of the circumferential wall member;

an upper surface member opposite to the lower surface member, the upper surface member defining a hole; and a fuel supply unit comprising:

a pump module disposed in the fuel tank, the pump module comprising:

a cover member adapted to be secured to the upper surface member of the fuel tank in such a manner as to block the hole defined by the upper surface member;

a fuel pump;

a suction filter; and a fuel return pipe for returning a part of the fuel discharged from the fuel pump into the fuel tank, each of the fuel pump and the suction filter being mounted on a lower portion of the cover member;

a chamber adapted to be movably mounted to the pump module, the chamber being disposed in a position to receive the suction filter for forming a fuel reservoir around the suction filter, the chamber comprising:

a suction pump for sucking fuel in the fuel tank to the fuel reservoir using fuel which is returned into the fuel tank; and a pipe for the suction pump, the pipe for the suction pump being adapted to engage with the fuel return pipe in such a manner as to move relative to the fuel return pipe, and leading the fuel outflowing from the fuel return pipe to the suction pump; and a biasing means disposed between the cover member and the chamber, the biasing means biasing the chamber toward the lower surface member of the fuel tank so as to maintain the chamber at the lower surface member of the fuel tank, wherein the biasing means is a coil spring which is mounted around an external circumference of one of the fuel return pipe and the pipe for the suction pump.

11. The fuel tank as claimed in claim 7, in which the pump module further comprises a pressure regulator for regulating a pressure of the fuel, by returning into the fuel tank a part of the fuel discharged from the fuel pump, and in which the pressure regulator has a return port which is connected to the suction pump.

12. The fuel tank as claimed in claim 11, in which the fuel supply unit of the fuel tank constitutes a non-return type fuel supply system.

13. The fuel tank as claimed in claim 7, in which the fuel supply unit further comprises a pressure regulator disposed outside the fuel tank, the pressure regulator being for regulating a pressure of the fuel, by returning into the fuel tank a part of the fuel discharged from the fuel pump, and in which the pressure regulator has a return port which is connected to the suction pump by way of the pump module.

14. The fuel tank as claimed in claim 13, in which the fuel supply unit of the fuel tank constitutes a full-return type fuel supply system.

15. A fuel supply unit comprising:

a pump module disposed in a fuel tank, the pump module comprising:

a cover member adapted to be mounted to an upper surface member of the fuel tank;

a fuel pump;

a fuel filter; and a suction filter comprising:

a bracket mounted to a suction port of the fuel pump;

a filter member made of plastic mesh material, and so mounted to the bracket as to cover the suction port of the fuel pump; and a press spring having a first end portion mounted to the bracket, and a second end portion for pressing the filter member to the bottom portion of the chamber, wherein each of the fuel pump, the fuel filter, and the suction filter is mounted on a lower portion of the cover member;

a chamber adapted to be movably mounted to the pump module, the chamber being disposed in a position to receive the suction filter for forming a fuel reservoir around the suction filter, the chamber comprising a suction pump for sucking fuel in the fuel tank to the fuel reservoir using fuel which is returned into the fuel tank; and a biasing means disposed between the cover member and the chamber, the biasing means biasing the chamber toward a lower surface member of the fuel tank opposite to the upper surface member so as to maintain the chamber at the lower surface member of the fuel tank, wherein the chamber is adapted to move upward and downward, wherein the chamber is shaped substantially into a tube having an upper portion which is opened and a lower portion which is opposite to the upper portion and is formed with a bottom portion, and wherein the upper portion of the chamber is connected to the pump module while the bottom portion of the chamber abuts on the lower surface member of the fuel tank.

16. A fuel tank for supplying fuel to an engine, the fuel tank comprising:

a circumferential wall member;

a lower surface member disposed in a lower portion of the circumferential wall member;

an upper surface member opposite to the lower surface member, the upper surface member defining a hole; and a fuel supply unit comprising:

a pump module disposed in the fuel tank, the pump module comprising:

a cover member adapted to be secured to the upper surface member of the fuel tank in such a manner as to block the hole defined by the upper surface member;

a fuel pump; and a suction filter comprising:

a bracket mounted to a suction port of the fuel pump;

a filter member made of plastic mesh material, and so mounted to the bracket as to cover the suction port of the fuel pump; and a press spring having a first end portion mounted to the bracket, and a second end portion for pressing the filter member to the bottom portion of the chamber, each of the fuel pump and the suction filter being mounted on a lower portion of the cover member;

a chamber adapted to be movably mounted to the pump module, the chamber being disposed in a position to receive the suction filter for forming a fuel reservoir around the suction filter, the chamber comprising a suction pump for sucking fuel in the fuel tank to the fuel reservoir using fuel which is returned into the fuel tank; and a biasing means disposed between the cover member and the chamber, the biasing means biasing the chamber toward the lower surface member of the fuel tank so as to maintain the chamber at the lower surface member of the fuel tank, wherein the chamber is adapted to move upward and downward, wherein the chamber is shaped substantially into a tube having an upper portion which is opened and a lower portion which is opposite to the upper portion and is formed with a bottom portion, and wherein the upper portion of the chamber is connected to the pump module while the bottom portion of the chamber abuts on the lower surface member of the fuel tank.

* * * * *